US007800478B2

(12) United States Patent
Puhalla et al.

(10) Patent No.: US 7,800,478 B2
(45) Date of Patent: Sep. 21, 2010

(54) ELECTRICAL SWITCHING APPARATUS AND HEATER ASSEMBLY THEREFOR

(75) Inventors: Craig J. Puhalla, Moon Township, PA (US); David E. Little, Midland, PA (US); Kelly J. McCarthy, Pittsburgh, PA (US); Robert W. Mueller, Aliquippa, PA (US); Wilbert E. Lindsay, Bulger, PA (US)

(73) Assignee: Eaton Corporation, Cleveland, OH (US)

( * ) Notice: Subject to any disclaimer, the term of this patent is extended or adjusted under 35 U.S.C. 154(b) by 154 days.

(21) Appl. No.: 12/130,260

(22) Filed: May 30, 2008

(65) Prior Publication Data

US 2009/0295532 A1 Dec. 3, 2009

(51) Int. Cl.
*H01H 61/00* (2006.01)
*H01H 71/50* (2006.01)

(52) U.S. Cl. ..... 337/107; 337/100; 337/102; 337/103; 337/104; 335/43; 335/145

(58) Field of Classification Search ..... 337/102–104, 337/100, 107; 335/43, 145
See application file for complete search history.

(56) References Cited

U.S. PATENT DOCUMENTS 3,116,388 A * 12/1963 Hobson, Jr. ..... 337/173
3,562,688 A * 2/1971 Kussy et al. ..... 337/62
3,622,930 A * 11/1971 D'Entremont ..... 337/107
3,808,572 A * 4/1974 Gaskill ..... 337/106
3,852,694 A * 12/1974 Di Marco et al. ..... 337/62
4,630,019 A * 12/1986 Maier et al. ..... 337/70
4,633,210 A * 12/1986 Mallonen et al. ..... 337/101
4,695,814 A * 9/1987 Matsumoto et al. ..... 337/77
4,733,033 A * 3/1988 Morris et al. ..... 200/401
4,761,626 A * 8/1988 Teraoka ..... 335/16
5,608,367 A 3/1997 Zoller et al.
5,831,509 A * 11/1998 Elms et al. ..... 337/333
5,844,466 A * 12/1998 Fraisse ..... 337/379
5,859,578 A * 1/1999 Arnold ..... 337/110
5,872,495 A * 2/1999 DiMarco et al. ..... 335/35
5,877,670 A * 3/1999 Sehlhorst et al. ..... 337/302
6,215,379 B1 * 4/2001 O'Keefe et al. ..... 335/35

(Continued)

FOREIGN PATENT DOCUMENTS

FR 2553928 A1 * 4/1985

(Continued)

*Primary Examiner*—Anatoly Vortman
(74) *Attorney, Agent, or Firm*—Martin J. Moran

(57) ABSTRACT

A heater assembly is provided for an electrical switching apparatus. The heater assembly includes a heater element and an elongated bimetal. The heater element includes first and second ends, an intermediate portion disposed therebetween and an aperture disposed proximate the first end. The elongated bimetal includes opposing first and second ends, and is movable between first and second positions corresponding respectively to the separable contacts of the electrical switching apparatus being closeable, and to the first end of the elongated bimetal cooperating with a trip bar to cause an operating mechanism to open the separable contacts. The second end of the elongated bimetal is coupled to the intermediate portion of the heater element. When the elongated bimetal is disposed in the first position, the first end of the elongated bimetal extends beyond the upper surface of the first end of the heater element into the aperture of the heater element.

8 Claims, 7 Drawing Sheets

U.S. PATENT DOCUMENTS

| | | | | |
|---|---|---|---|---|
| 6,297,717 | B1 | 10/2001 | Heckenkamp et al. | |
| 6,326,869 | B1 * | 12/2001 | Felden et al. | 335/35 |
| 6,407,653 | B1 | 6/2002 | Zindler et al. | |
| 6,633,211 | B1 | 10/2003 | Zindler et al. | |
| 6,803,850 | B2 * | 10/2004 | Richter | 337/107 |
| 6,876,532 | B2 | 4/2005 | Engel et al. | |
| 6,972,936 | B2 * | 12/2005 | Morris | 361/42 |
| 7,250,836 | B2 * | 7/2007 | Fleege et al. | 335/6 |
| 7,397,339 | B2 * | 7/2008 | Berg et al. | 337/99 |
| 7,518,482 | B2 * | 4/2009 | Fleege | 337/59 |
| 2002/0063619 | A1 * | 5/2002 | Nagahiro et al. | 337/39 |
| 2002/0158746 | A1 * | 10/2002 | Lamborghini et al. | 337/365 |
| 2004/0070483 | A1 * | 4/2004 | Richter | 337/23 |
| 2004/0085702 | A1 * | 5/2004 | Ohkubo | 361/161 |

FOREIGN PATENT DOCUMENTS

| | | | |
|---|---|---|---|
| JP | 02299119 | A * | 12/1990 |

* cited by examiner

ELECTRICAL SWITCHING APPARATUS AND HEATER ASSEMBLY THEREFOR

CROSS-REFERENCE TO RELATED APPLICATION

This application is related to commonly assigned, concurrently filed:

U.S. patent application Ser. No. 12/130,170, filed May 30, 2008, entitled "Magnetic Trip Mechanism and Electrical Switching Apparatus Employing Same.

BACKGROUND OF THE INVENTION

1. Field of the Invention

The invention relates generally to electrical switching apparatus and, more particularly, to electrical switching apparatus, such as circuit breakers. The invention also relates to heater assemblies for electrical switching apparatus.

2. Background Information

Electrical switching apparatus, such as molded case circuit breakers, generally include at least one pair of separable contacts which are operated either manually, by way of a handle disposed on the outside of the circuit breaker housing, or automatically by way of a trip unit in response to a trip condition (e.g., without limitation, an overcurrent condition; a relatively high level short circuit or fault condition; a ground fault or arc fault condition).

Relatively small molded case circuit breakers, for example, that are used in residential and light industrial applications, typically include a thermal-magnetic trip unit having a heater assembly and a magnetic trip mechanism. As shown in FIG. 1, the heater assembly 1 includes a plurality of heater elements 3,5 and a bimetal 7. In operation, for example in response to an overload condition, electric current drawn by the load (not shown) heats the heater elements 3,5 which, in turn, heat the bimetal 7 causing it to bend (e.g., in the direction of arrow 9 of FIG. 1) in a well known manner. When the bimetal 7 bends, it cooperates, directly or indirectly, with a trip bar 11 (shown in simplified form in phantom line drawing in FIG. 1) of the circuit breaker operating mechanism 13 (shown in block form), thereby moving (e.g., pivoting) the trip bar 11, which unlatches the operating mechanism 13 to open (e.g., separate) the separable contacts 15,17 of the circuit breaker (not shown) and interrupt the flow of electric current. Thus, the heater assembly 1 functions to provide a thermal trip response that is directly related to the magnitude of current drawn by the load.

Among other disadvantages, the structure and, in particular, the length 19 of the bimetal 7 is constrained by the limited amount of space that is available within the circuit breaker housing (not shown). The limited length 19 of the bimetal 7 constrains the mechanical advantage provided by the bimetal 7, when it bends. Accordingly, the amount of force exerted by the bimetal 7 on the trip bar 11, when the bimetal 7 is heated and bends, is undesirably limited. Additionally, the heater elements 3,5 must be suitably coupled (e.g., welded) together, which increases the complexity and cost of the heater assembly 1. The connection (e.g., weld) between the heater elements 3,5 can also provide thermal resistance, which adversely affects the thermal performance of the circuit breaker (not shown).

There is, therefore, room for improvement in electrical switching apparatus and in heater assemblies therefor.

SUMMARY OF THE INVENTION

These needs and others are met by embodiments of the invention, which are directed to a heater assembly for electrical switching apparatus. The heater assembly includes a heating element which, among other benefits, accommodates an elongated bimetal, thereby improving the thermal performance of the electrical switching apparatus.

As one aspect of the invention, a heater assembly is provided for an electrical switching apparatus. The electrical switching apparatus includes a housing, separable contacts, and an operating mechanism for opening and closing the separable contacts. The heater assembly comprises: a heater element structured to be coupled to the housing of the electrical switching apparatus, the heater element including a first end, a second end, an intermediate portion disposed between the first end and the second end, and an aperture disposed proximate to the first end, the first end of the heater element including an upper surface and a lower surface disposed opposite the upper surface; and an elongated bimetal including a first end and a second end disposed opposite and distal from the first end of the elongated bimetal, the elongated bimetal being structured to move between a first position corresponding to the separable contacts of the electrical switching apparatus being closeable, and a second position corresponding to the first end of the elongated bimetal cooperating with the operating mechanism to open the separable contacts, the second end of the elongated bimetal being coupled to the intermediate portion of the heater element. When the elongated bimetal is disposed in the first position, the first end of the elongated bimetal extends beyond the upper surface of the first end of the heater element into the aperture of the heater element.

The heater element may be a singular member comprising one continuous piece of material. The intermediate portion of the heater element may comprise a plurality of bends defining a plurality of segments, and the aperture of the heater element may extend from proximate the first end of the heater element toward a corresponding one of the segments of the intermediate portion. The aperture of the heater element may be an elongated slot, and the elongated slot may extend through the corresponding one of the segments of the intermediate portion. The first end of the heater element may be parallel with respect to the second end of the heater element. The plurality of bends of the intermediate portion of the heater element may comprise a first bend, a second bend, a third bend and a fourth bend, and the plurality of segments of the intermediate portion of the heater element may comprise a first portion, a second portion and a third portion. The first segment may be disposed between the first bend and the second bend and may be perpendicular with respect to the first end of the heater element, the second segment may be disposed between the second bend and the third bend and may extend perpendicularly outwardly from the first segment, and the third segment may be disposed between the third bend and the fourth bend and may extend perpendicularly outwardly from the second segment substantially parallel with respect to the first segment.

The first segment of the heater element may have a length, and the elongated bimetal may have a length, wherein the length of the elongated bimetal is greater than the length of the first segment of the heater element. The first end of the elongated bimetal may include a projection extending outwardly from the elongated bimetal. When the elongated bimetal is disposed in the first position, at least a portion of the projection may extend beyond the upper surface of the heater element into the aperture of the heater element.

As another aspect of the invention, an electrical switching apparatus comprises: a housing; separable contacts enclosed by the housing; an operating mechanism structured to open and close the separable contacts; and at least one heater assembly comprising: a heater element coupled to the housing, the heater element including a first end, a second end, an intermediate portion disposed between the first end and the second end, and an aperture disposed proximate to the first end, the first end of the heater element including an upper surface and a lower surface disposed opposite the upper surface, and an elongated bimetal including a first end and a second end disposed opposite and distal from the first end of the elongated bimetal, the elongated bimetal being movable between a first position corresponding to the separable contacts of the electrical switching apparatus being closeable, and a second position corresponding to the first end of the elongated bimetal cooperating with the operating mechanism to open the separable contacts. When the elongated bimetal is disposed in the first position, the first end of the elongated bimetal extends beyond the upper surface of the first end of the heater element into the aperture of the heater element.

The operating mechanism may comprise a movable contact arm, the separable contacts may comprise a stationary electrical contact and a movable contact, and the movable contact may be disposed on the movable contact arm. The heater assembly may further comprise a number of shunts, wherein the number of shunts electrically connect the heater element to the movable contact arm, and wherein the number of shunts is substantially disposed on the crossover segment of the first end of the heater element, distal from the elongated bimetal.

The electrical switching apparatus may be a circuit breaker, and the operating mechanism of the circuit breaker may comprise a trip bar. The circuit breaker may have a plurality of poles, wherein the trip bar extends across the poles of the circuit breaker. The at least one heater assembly may be a plurality of heater assemblies, one for each of the poles of the circuit breaker, wherein each of the heater assemblies is cooperable with a corresponding portion of the trip bar.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
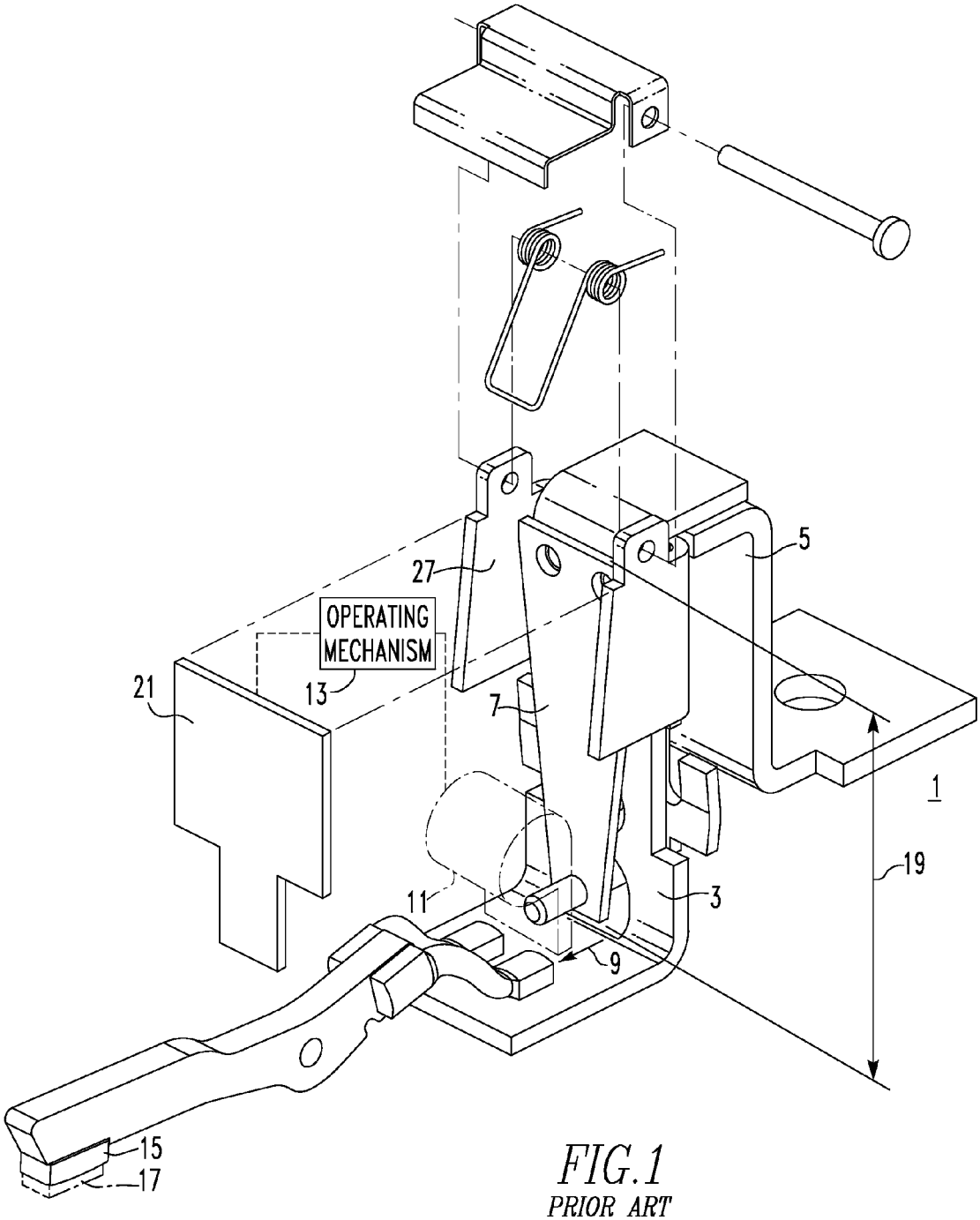
FIG.1 PRIOR ART
FIG. 1 is a partially exploded isometric view of a heater assembly and a magnetic trip mechanism.

Directional phrases used herein, such as, for example, front, back, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts, as well as connecting mechanisms that do not require a separate fastening element (e.g., without limitation, a rivet; a screw; a bolt and a nut; a combination of bolts, washers and nuts) such as, for example and without limitation, an arrangement interlocking protrusions (e.g., without limitation, tabs; projections) and openings (e.g., without limitation, recesses; holes; slots).

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
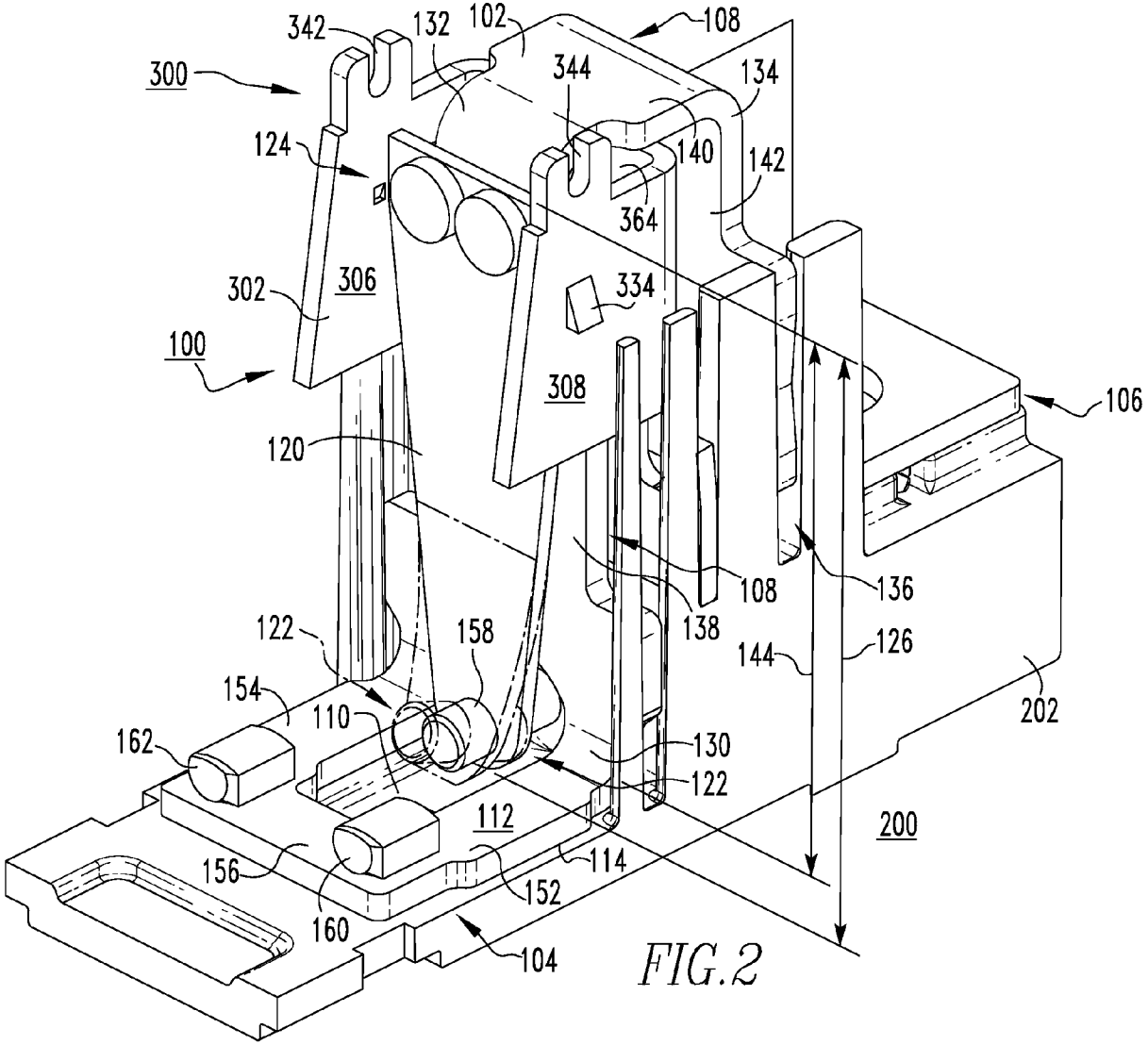
FIG. 2 is an isometric view of a heater assembly, in accordance with an embodiment of the invention.
Figure 4:
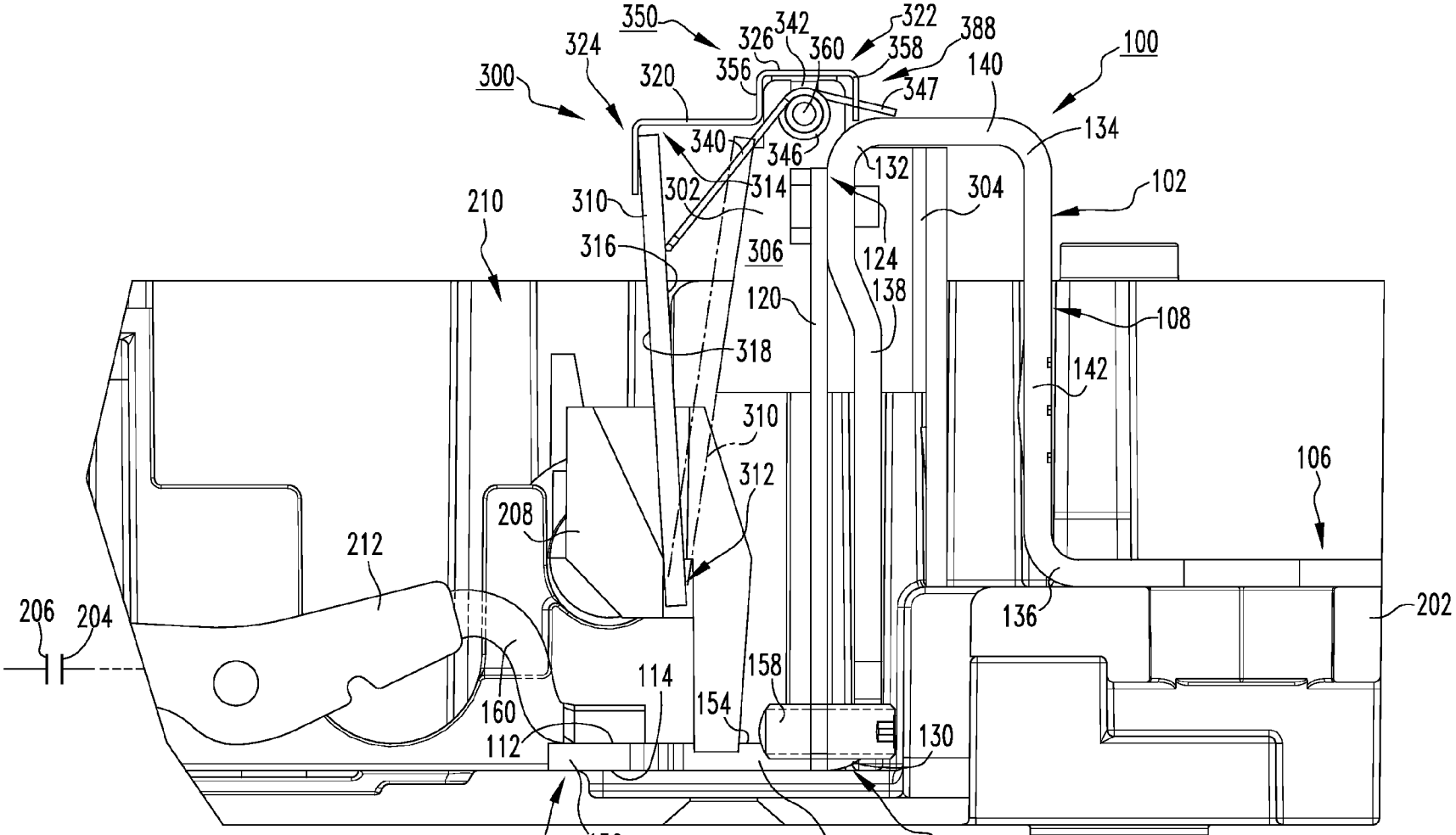
FIG. 4 is a side elevation view of a portion of a circuit breaker, in accordance with another embodiment of the invention, with a portion of the circuit breaker housing removed to show internal structures.
Figure 5:
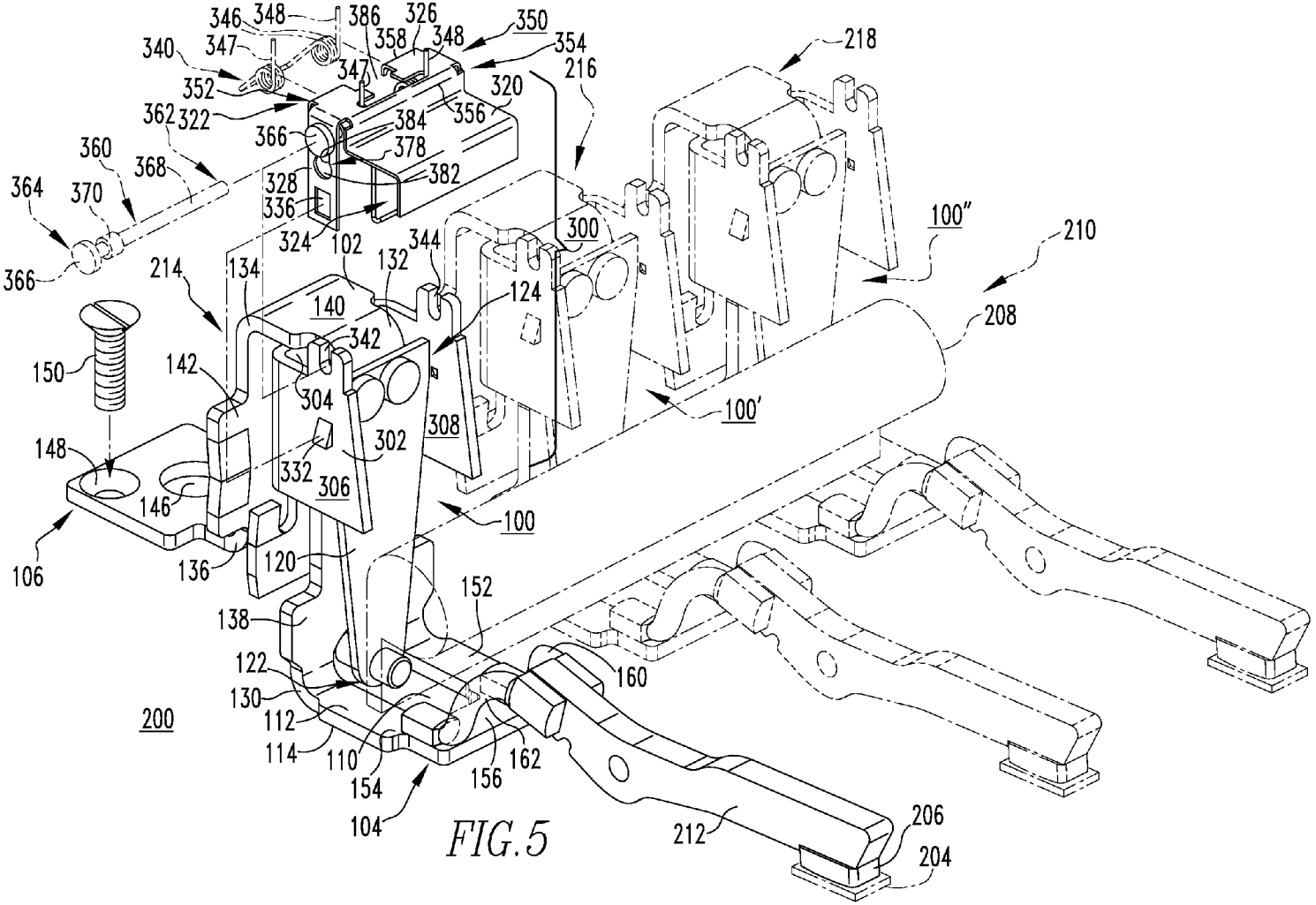
FIG. 5 is a partially exploded isometric view of the heater assembly and magnetic trip mechanism of the circuit breaker of FIG. 4.

FIG. 2 shows a heater assembly 100 for an electrical switching apparatus, such as a circuit breaker 200 (partially shown in FIG. 2; see also FIGS. 4 and 5). The circuit breaker 200, which is best shown in FIG. 4, includes a housing 202, separable contacts 204,206 (shown in simplified form in FIG. 4; best shown in FIG. 5), and a trip bar 208 (see also trip bar 208 shown in simplified form in phantom line drawing in FIG. 5). The trip bar 208 is structured to cooperate with an operating mechanism (indicated generally in FIGS. 4 and 5 as reference number 210) to open and close the separable contacts 204,206 (FIGS. 4 and 5), in a generally well known manner.

Figure 3:
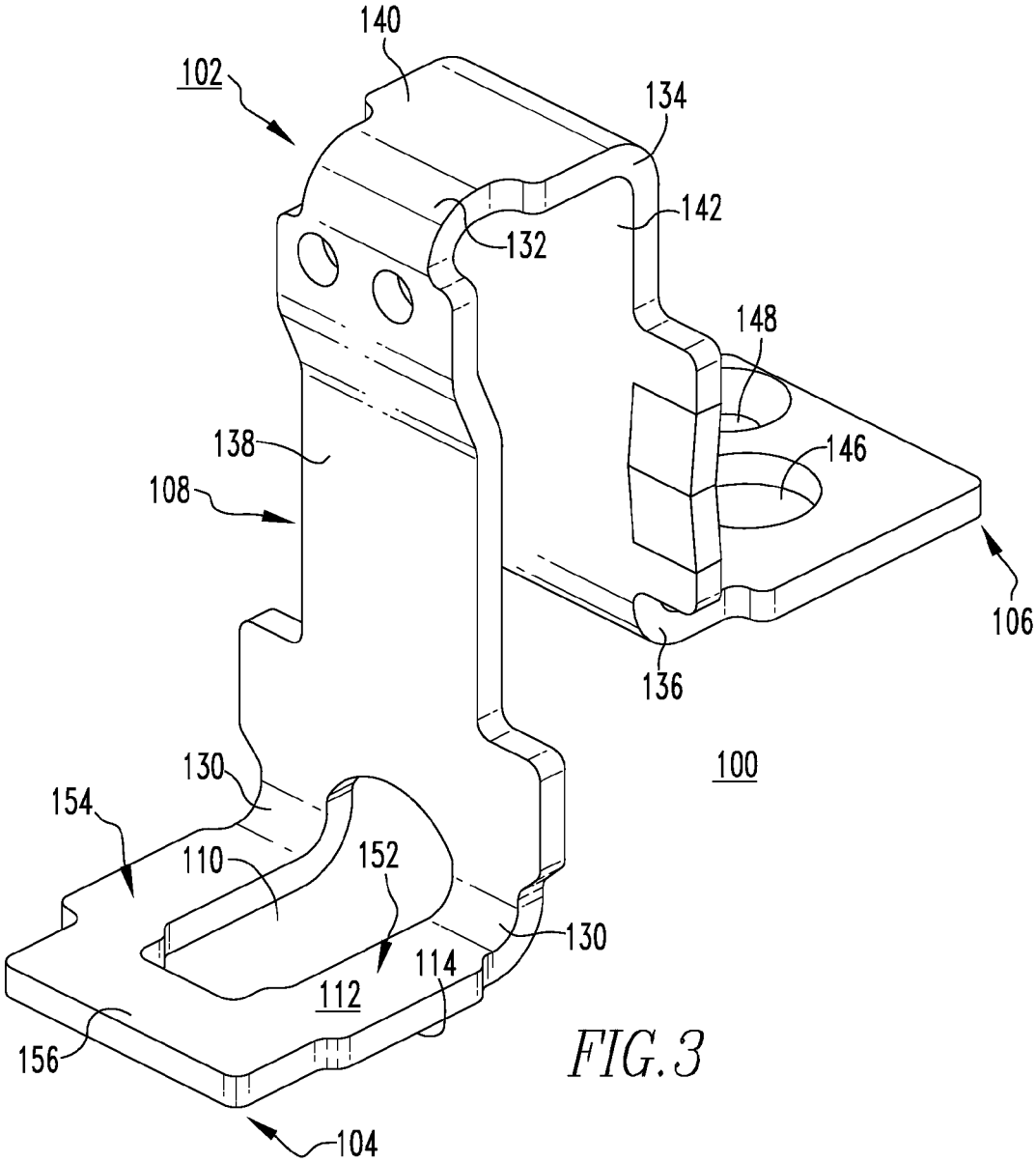
FIG. 3 is an isometric view of the heater element of the heater assembly of FIG. 2.

The heater assembly 100 includes a heater element 102 coupled to the circuit breaker housing 202. As shown in FIG. 3, the example heater element 102 includes a first end 104, a second end 106 and an intermediate portion 108 disposed therebetween. An aperture 110 is disposed proximate to the first end 104 and extends through the opposing upper and lower surfaces 112,114 of the first end 104. Among other distinctions, unlike conventional heater assemblies (e.g., heater assembly 1 of FIG. 1) which have a plurality of heater elements (two heater elements 3,5 are shown in FIG. 1), that must be suitably joined (e.g., without limitation, welded) together, the example heater element 103 is a singular member consisting of one continuous piece of suitably electrically and thermally conductive material (e.g., without limitation, copper).

Referring again to FIG. 2, and also to FIGS. 4 and 5, the heater assembly 100 also includes an elongated bimetal 120 having first and second opposing ends 122,124. The elongated bimetal 120 is movable between a first position (shown in FIG. 2 in solid line drawing; also shown in FIG. 4), corresponding to the circuit breaker separable contacts 204,206 (FIGS. 4 and 5) being closable, and a second position (shown in phantom line drawing in FIG. 2), corresponding to the first end 122 of the elongated bimetal 120 being bent to cooperate with the aforementioned trip bar 208 (FIG. 4). Specifically, the elongated bimetal 120 is heated by heat energy that is generated by the flow of a predetermined current as it flows through the heater element 102 and, as a result, bends in a generally well known manner to move the trip bar 208 (FIGS. 4 and 5) and unlatch the operating mechanism 210 to trip open the separable contacts 204,206 (FIGS. 4 and 5). The second end 124 of the elongated bimetal 120 is suitably coupled (e.g., without limitation, riveted) to the intermediate portion 108 of the aforementioned heater element 102.

As will be described in greater detail hereinbelow, the example heater assembly 100 is particularly unique in that the elongated bimetal 120 is longer than conventional bimetals (see, for example, bimetal 7 of heater assembly 1 of FIG. 1). Specifically, when the elongated bimetal 120 is disposed in the first position (shown in solid line drawing in FIG. 2; also shown in FIG. 4), the first end 122 of the elongated bimetal 120 extends beyond the upper surface 112 of the first end 104 of the heater element 102 into the aperture 110 thereof. Accordingly, the length 126 (FIG. 2) of the elongated bimetal 120 is greater than the length 144 (FIG. 2) of the heater element 102 and, in particular, the first segment 138 (described hereinbelow) thereof.

As best shown in FIG. 3, the intermediate portion 108 of the heater element 102 comprises a plurality of bends (e.g. without limitation, 130,132,134,136), which define a plurality of segments (e.g., without limitation, 138,140,142). In the example shown and described herein, the first and second ends of 104,106 of the heater element 102 are parallel with respect to one another, and the plurality of bends of the intermediate portion 108 includes a first bend 130, a second bend 132, a third bend 134 and a fourth bend 136, defining first, second and third segments 138,140,142. Specifically, the first segment 138 is disposed between the first bend 130 and the second bend 132, and is perpendicular with respect to the first end 104 of the heater element 102. The second segment 140 is disposed between the second bend 132 and the third bend 134, and extends perpendicularly outwardly from the first segment 138. The third segment 142 is disposed between the third and fourth bends 134,136 and extends perpendicularly outwardly from the second segment 140, substantially parallel with respect to the first segment 138. It will, however, be appreciated that the heater element (e.g., 102) could have any known or suitable alternative number and/or configuration of bends (not shown).

The aforementioned aperture 110 of the example heater element 102 is in an elongated slot 110, which extends from proximate the first end 104 of the heater element 102 through the first segment 138 of the intermediate portion 108 of the heater element 102, as shown. Thus, the elongated slot 110 substantially divides the first end 104 into first and second sides 152,154, wherein the first end 122 of the elongated bimetal 120 extends between the first and second sides 152, 154, as shown in FIGS. 2 and 5. The first end 104 of the heater element 102 further includes a crossover segment 156, which extends between and interconnects the first and second sides 152,154 of the heater element 102, so as to maintain the strength and rigidity of the first end 104 of the heater element 102, despite the presence of the elongated slot 110 therein. It will be appreciated that the crossover segment 156 also functions to prevent the first and second sides 152,154 from being undesirably attracted together, for example, in response to the magnetic attraction created by the flow of electrical current through the sides 152,154, which are substantially parallel with respect to one another.

As shown in FIG. 4, of the elongated bimetal 120 also includes a projection 158 (also shown in FIGS. 2 and 5), which extends outwardly from the first end 122 of elongated bimetal 120. When the elongated bimetal 120 is disposed in the first position, shown in FIG. 4, at least a portion of the projection 158 extends beyond the upper surface 112 of the heater element 102 into the aperture 110 of the heater element 102, as shown. This is an entirely different structure than conventional heater assemblies (see, for example, heater assembly 1 of FIG. 1) wherein the entire bimetal (see, for example, bimetal 7 of FIG. 1) is disposed above the upper surface of the first end of the heater element (see, for example, upper surface (not numbered) of heater element 3 of FIG. 1). In fact, known heater elements are devoid of an aperture that extends through the upper and lower surfaces of the first end thereof.

As shown in FIGS. 3 and 5, the second end 106 of the example heater element 102 further includes a plurality of holes 146,148 (two are shown). A suitable fastener such as, for example the screw 150 shown in FIG. 5, is structured to extend through a corresponding one of the holes 148, to fasten the heater element 102 to the circuit breaker housing 202 (FIGS. 2 and 4). It will, however, be appreciated that the heater element (e.g., 102) may have any known or suitable alternative number and/or configuration of holes (not shown) and fasteners (not shown) therefor, without departing from the scope of the invention.

Continuing to refer to FIG. 5, it will also be appreciated that, while for economy of disclosure only one heater assembly 100 has been shown and described in detail herein, that the circuit breaker 200 could employ a plurality of heater assemblies 100,100',100". For example, and without limitation, FIG. 5 illustrates a three pole circuit breaker 200, wherein each pole 214,216,218 of the circuit breaker 200 has a corresponding heater assembly 100,100',100". Poles 216 and 218 and heater assemblies 100' and 100" are shown in phantom line drawing in FIG. 5. It will be appreciated, however, that they are substantially the same as pole 214 and heater assembly 100, which are shown in solid line drawing and described in detail. The trip bar 208 (shown in simplified form in phantom line drawing in FIG. 5) of the example circuit breaker 200 extends across all three poles 214,216,218 of the circuit breaker 200 and, therefore, is cooperable with each of the heater assemblies 100,100',100".

Accordingly, the disclosed heater assembly 100 (see also heater assemblies 100' and 100" of FIG. 5) includes an elongated bimetal 120 having an extended length 126 (FIG. 2) that provides a mechanical advantage (e.g., without limitation, increased lever arm and associated actuating force) for actuating the trip bar 208 (shown in simplified form in FIG. 5). This is accomplished by a unique heater element 102 which, among other benefits, is a single piece member made from a single continuous piece of suitable electrically and thermally conductive material and includes an aperture 110 to accommodate the extended length 126 (FIG. 2) of the elongated metal 120. Moreover, as shown in FIG. 5, the shunts 160,162, which electrically connect the heater element 102 to the movable contact arm 212 of the circuit breaker 200, are advantageously positioned farther away from the elongated bimetal 120 and the trip bar 208 compared to known heater assemblies (see, for example, heater assembly 1 of FIG. 1). This advantageously decreases the potential for the shunts 160,162 to unintentionally interfere with (e.g., become entangled with) the trip bar (e.g., 208). Specifically, as best shown in FIG. 2, the example heater assembly 100 includes first and second shunts 160,162 (partially shown in FIG. 2). The first shunt 160 is electrically connected to the heater element 102 at the first side 152 of the first end 104 of the heater element 102, and the second shunt 162 is electrically connected to the heater element 102 at the second side 154 of the first end 104 of the heater element 102, opposite the first shunt 160. Both shunts 160,162 are substantially disposed on the crossover segment 156 of the heater element 102, distal from the elongated bimetal 120.

In addition to the aforementioned heater assembly 100, the example circuit breaker 200 (FIGS. 2, 4 and 5) also includes a magnetic trip mechanism 300 (partially shown in FIG. 2; see also FIGS. 4-7). The magnetic trip mechanism 300 includes a magnetic member 302, which is coupled to the circuit breaker house 202, as shown in FIG. 2, an armature 310, shown in FIG. 4. The armature 310 (FIG. 4) is movable with respect to the magnetic member 302 to provide the desired trip response, in a generally well known manner. More specifically, the armature 310 includes a first end 312 structured to cooperate with the trip bar 208, a second end 314 disposed opposite and distal from the first end 312, a first side 316 facing the magnetic member 302, and a second side 318 facing away from the magnetic member 302. The armature 310 is movable among a first position (shown in phantom line drawing), corresponding to the separable contacts 204,206 (shown in simplified form in FIG. 4; see also FIG. 5) of the circuit breaker 200 being tripped open, and a second position (shown in FIG. 4), corresponding to the separable contacts 204,206 being closable.

The magnetic trip mechanism 300 further includes an armature restraint 320 having a first portion 322 and a second portion 324 distal therefrom. A biasing element 340 is removably coupled to the first portion 322, as will be described. When the armature 310 is disposed in the first position, a portion of the first side 316 of the armature 310 engages the magnetic member 302 and, when the armature 310 is disposed in the second position, a portion of the second side 318 of the armature 310 engages the second portion 324 of the armature restraint 320, as shown in FIG. 4.

As best shown in FIG. 5, the armature restraint 320 and biasing element 340, which in the example shown and described herein is a spring 340 (shown in phantom line drawing in FIG. 5; also partially shown in solid line drawing in FIGS. 6B and 7), form a sub-assembly 350. As will be described hereinbelow, the first portion 322 of the armature restraint 320 removably couples the sub-assembly 350 to the magnetic member 302. Accordingly, among other benefits, the sub-assembly 350 is structured to be relatively quickly and easily connected and disconnected from the magnetic member 302, without requiring the separate individual components (spring 340; pin 366, described hereinbelow; armature restraint 320) to be individually aligned with respect to the magnetic member 302, in order to attach them to the magnetic member 302. Accordingly, it will be appreciated that the magnetic trip mechanism 300 can be relatively quickly and easily modified or replaced, such that is suitable for use in a wide variety of different applications. In addition, the disclosed sub-assembly 350 advantageously does not require the spring 340 to be charged before or in the midst of assembly of the magnetic trip mechanism 300. Rather, the spring 340 of the example magnetic trip mechanism 300 is chargeable to bias the armature 310 away from the first position toward the second position (shown in FIG. 4), after the sub-assembly 350 has already been removably coupled to the magnetic member 302, as will be described. This substantially simplifies the assembly process, as winding or spinning the biasing element (e.g., without limitation, spring 340) during assembly of the magnetic trip mechanism (e.g., 300) is not required.

The quick-connect and disconnect functionality between the disclosed magnetic member 302 and sub-assembly 350 will now be described in greater detail. Specifically, in the example shown and described herein, the magnetic member 302 includes the body 304 and first and second opposing walls 306,308 extending perpendicularly outwardly from the body 304. Each of the walls 306,308 has a projection 332 (FIGS. 5 and 6A), 334 (FIGS. 2 and 7), respectively. The first portion 322 of the armature restraint 320 includes a top 326, a first tab 328 (FIGS. 5, 6A and 6B) extending perpendicularly outwardly from the top 326, and a second tab 330 (FIG. 7) extending perpendicularly outwardly from the top 326 opposite the first tab 328. The first tab 328 is structured to be removably coupled to the first wall 306 of the magnetic member 302, and the second tab 330 is structured to be removably coupled to the second wall 308 of the magnetic member 302. More specifically, when the sub-assembly 350 is removably coupled to the magnetic member 302, the first projection 332 of the first wall 306 of the magnetic member 302 is disposed in an aperture 336 of the first tab 328, as shown in FIG. 6A, and the second projection 334 of the second wall 308 of the magnetic member 302 is disposed in an aperture 338 of the second tab 330, as shown in FIG. 7.

Referring again to FIG. 5, the sub-assembly 350 of the example magnetic trip mechanism 300 further includes a pin 360 (shown in phantom line drawing in FIG. 5; also partially shown at head 366 in solid line drawing in the installed position in FIG. 5). The pin 360 removably couples the spring 340 to the first and second tabs 328,330 (both shown in FIG. 7) of the armature restraint 320. More specifically, the first and second magnetic member walls 306,308 include cradles 342,344, respectively, and the spring 340 has a plurality of coils 346 (show in phantom line drawing in FIG. 5; see also FIGS. 4, 6B and 7). The pin 360 extends through the first tab 328 of the armature restraint 320, through the coils 346 of the spring 340 and through the second tab 330 of the armature restraint 320, as best shown in FIG. 7. When the sub-assembly 350 is removably coupled to the magnetic member 302 of the magnetic trip mechanism 300, the pin 360 is disposed in the first and second cradles 342,344 of the first and second sides 306,308, respectively, of the magnetic member 302. Therefore, it will be appreciated that the cradles 342,344 facilitate the advantageous quick-connect and disconnect capabilities of the sub-assembly 350.

The example pin 360 includes first and second opposing ends 362,364, a head 366 disposed at the second end 364 of the pin 360, a shank 368 extending between the first end 362 and the head 366, and an enlarged portion 370 disposed proximate to the second end 364, as shown in phantom line drawing in FIG. 5. More specifically, the enlarged portion 370 of the pin 360 is spaced apart from the head 366. The shank 368 of the pin 360 has a first diameter 372 (FIG. 7), the head 366 of the pin 360 has a second diameter 374, and the enlarged portion 370 of the pin 360 has a third diameter 376 (FIG. 6B), wherein the third diameter 376 of the enlarged portion 370 is greater than the first diameter 372 of the shank 368, but smaller than the second diameter 374 of the head 366, as shown.

Figure 6A:
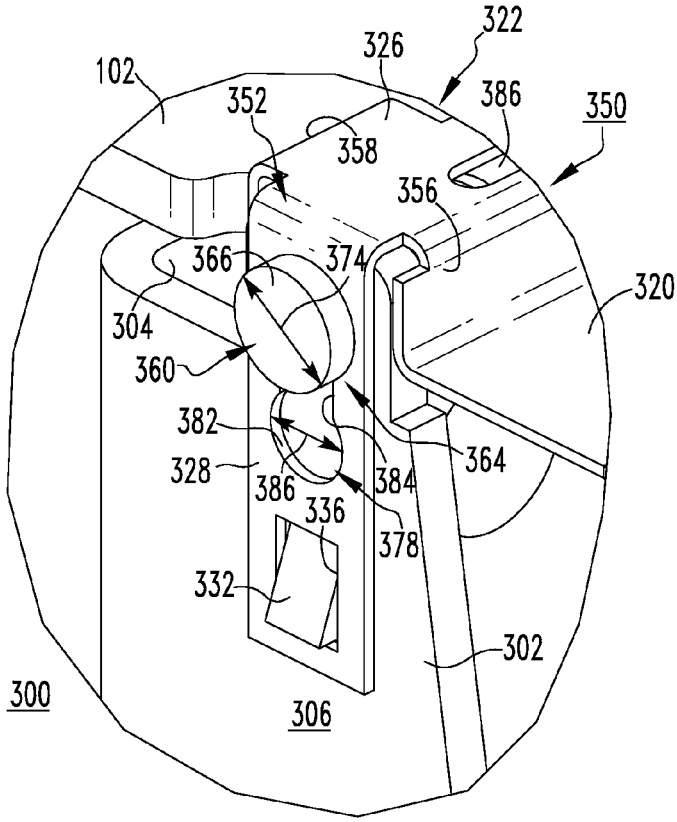
FIG. 6A is an enlarged isometric assembled view of a portion of one side of the magnetic trip mechanism of FIG. 5.
Figure 6B:
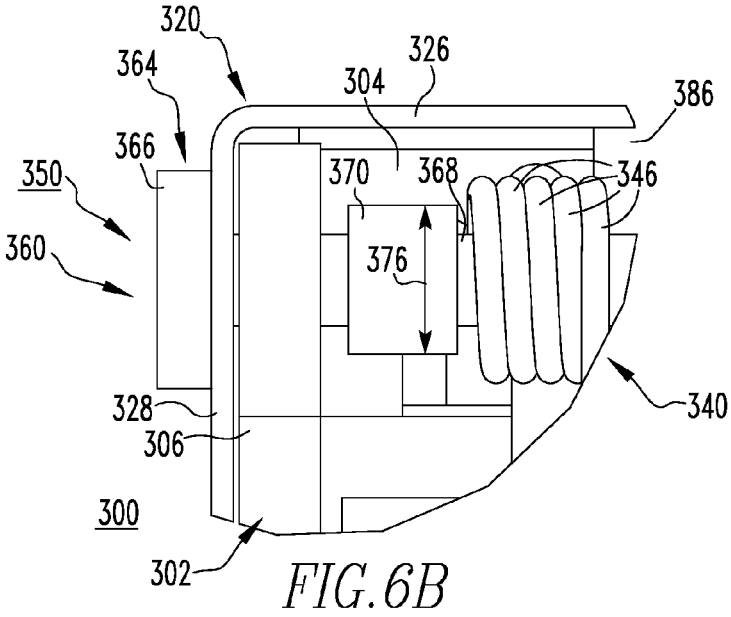
FIG. 6B is a front elevation view of the portion of the magnetic trip mechanism of FIG. 6A.
Figure 7:
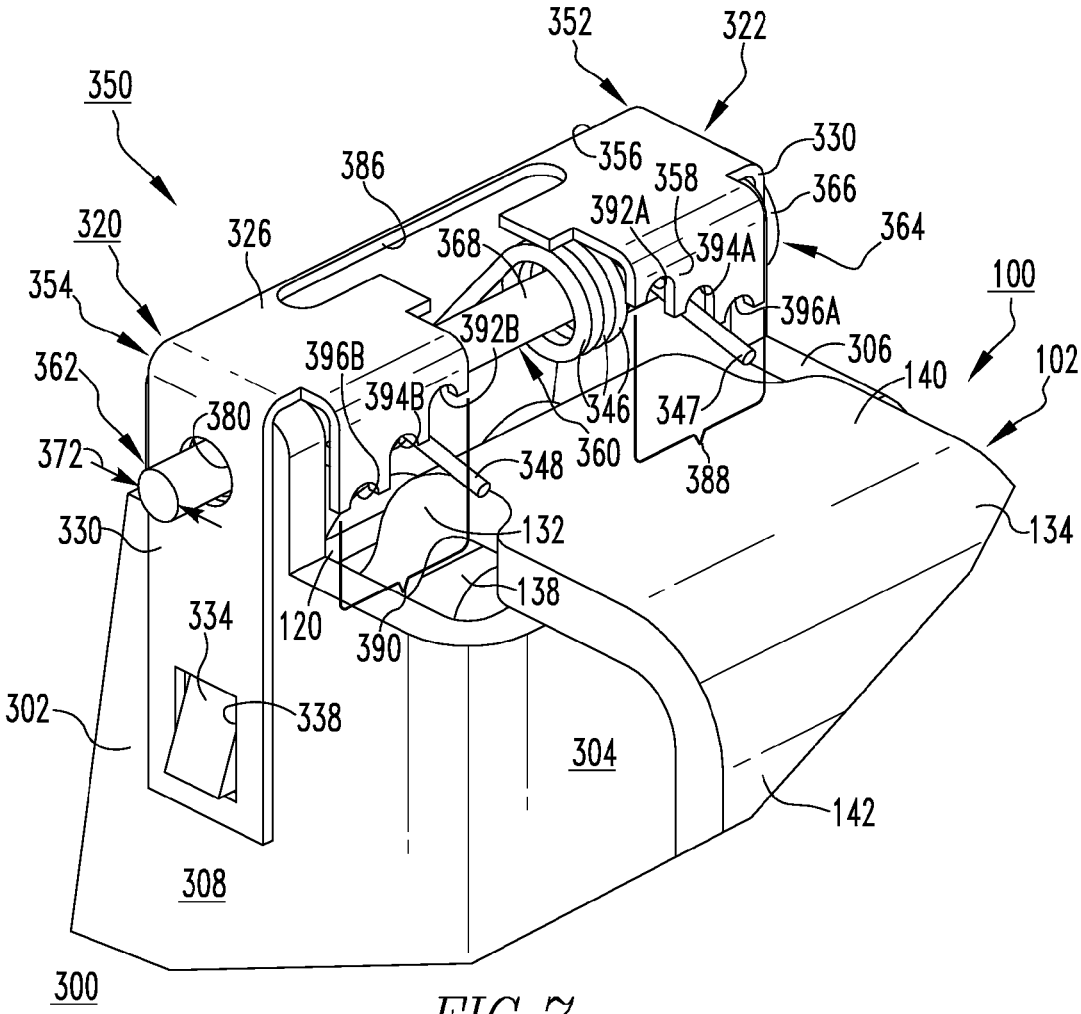
FIG. 7 is an isometric view of another side of the magnetic trip assembly of FIG. 6B.

The first tab 328 of armature restraint 320 includes a keyed aperture 378, as partially shown in FIGS. 5 and 6A, and the second tab 330 of the armature restraint 320 includes a pin hole 380, as shown in FIG. 7. The keyed aperture 378 consists of a circular opening 382 having a diameter 386, and a radial extension 384 extending outwardly from the circular opening 382, as shown in FIG. 6A. The keyed aperture 378 facilitates the ability of the pin 360 to removably couple the spring 340 to the armature restraint 320. Specifically, the diameter 386 of the circular opening 382 is larger than the third diameter 376 of the enlarged portion 370 of the pin 360. Accordingly, when the pin 360 is removably coupled to armature restraint 320, the first end 362 of the pin 360 extends through the pin opening 380 of the second tab 330 of armature restraint 320, as shown in FIG. 7, and the shank 368 of the pin 360, between the enlarged portion 370 of the pin 360 and the head 366 of the pin 360, is disposed within the radial extension 384 of the keyed aperture 378. Thus, the first tab 328 of armature restraint 320 is disposed between the enlarged portion 370 of the pin 360 and the head 366 of the pin 360, as best shown in FIG. 6B.

As will be appreciated with reference to FIG. 7, in addition to the quick-connect and disconnect advantages afforded by the aforementioned sub-assembly 350, the example magnetic trip mechanism 300 and, in particular the armature restraint 320 thereof, is also structured to enable the spring 340 to be charged after the sub-assembly 350 has already been removably coupled to the magnetic member 302, and further enables the biasing force provided by the spring 340 to be adjusted. More specifically, the spring 340 includes a number of legs 347,348. Prior to attachment of the sub-assembly 350 to the magnetic member 302, the legs 347,348 are disposed within a spring aperture 386 of the top 326 of the armature restraint 320, as shown in FIG. 5. In this orientation, the spring 340 is not charged, but is preferably retained in this position for easy access at the ends 352,354 thereof. The spring aperture 386 is disposed between the first and second ends 352,354 of the top 326 of the armature restraint 320, and extends from proximate the first edge 356 of the top 326, through the second edge 358 of the top 326, as shown. Accordingly, the structure of the spring aperture 386 permits the legs 347,348 of the spring 340 to be moved from the uncharged position shown in FIG. 5, to the charged position of FIG. 7.

In addition, the second edge 358 of the top 326 of the example armature restraint 320 has at least one adjustment portion 388,390 with which the spring legs 347,348 are cooperable in order to adjust (e.g., increase; decrease) the biasing force of the spring 340. In the example of FIG. 7, the adjustment portion consists of a first extension 388 extending outwardly from the top 326 of the armature restraint 320 proximate the first end 352 thereof, and a second extension 390 extending outwardly from the top 326 proximate the second end 354 thereof. Each of the extensions 388 and 390 includes a plurality of indents 392A,394A,396A and 392B,394B, 396B, respectively. When the sub-assembly 350 is removably coupled to the magnetic member 302, as shown, the first leg 347 of the spring 340 is moveable to a corresponding one of the indents 392A,394A,396A of the first extension 388, and the second leg 348 of the spring 340 is movable to a corresponding one of the indents 392B,394B,396B of the second extension 390, in order to charge the spring 340. Additionally, the biasing force of the spring 340 can be increased or decreased by changing the indents (e.g., without limitation, 392A,394A,396A,392B,394B,396B) within which the spring legs 347,348 are respectively disposed. For example and without limitation, moving spring leg 347 from indent 392A to indent 394A, and spring leg 348 from indent 392B to indent 394B would result in the spring bias force against the armature 310 (FIG. 4) being increased. Likewise, for example and without limitation, movement of spring leg 347 from indent 396A to indent 394A, and spring leg 348 from indent 396B to indent 394B would result in the spring force being decreased. It will be appreciated that the magnetic trip mechanism 300 could employ any known or suitable alternative number and/or configuration of adjustment portions (not shown) having any known or suitable number and/or configuration of indents (not shown) or other suitable adjustment mechanisms (not shown).

Accordingly, the disclosed magnetic trip mechanism 300 provides a sub-assembly 350 which, among other benefits, can be quickly and easily connected and disconnected, and wherein the spring 340 of the sub-assembly 350 is not required to be charged until after the sub-assembly 350 has already been removably coupled to the magnetic member 302. Additionally, the operating characteristics of the magnetic trip mechanism 300 can be relatively quickly and easily adjusted by merely adjusting the legs 347,348 of the existing spring 340 to change the biasing force that it provides, without requiring disassembly of the magnetic trip mechanism 300 and/or replacement of the spring 340 with another different spring (not shown), for example, of a different size.

It will be appreciated that although the circuit breaker 200 shown and described herein includes both the aforementioned heater assembly 100 and the aforementioned magnetic trip mechanism 300, that electrical switching apparatus (not shown) employing only one or the other of the disclosed heater assembly 100 and magnetic strip mechanism 300 in a wide variety of different configurations are also contemplated by the invention. Accordingly, both a heater assembly 100 and a magnetic trip mechanism 300 are provided which, among other benefits, serve to individually and/or collectively, facilitate the assembly of the circuit breaker 200 and improve the operating performance of the circuit breaker 200.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A heater assembly for an electrical switching apparatus, said electrical switching apparatus including a housing, separable contacts, and an operating mechanism for opening and closing said separable contacts, said heater assembly comprising:

a heater element structured to be coupled to the housing of said electrical switching apparatus, said heater element including a first end, a second end, an intermediate portion disposed between the first end and the second end, and an aperture disposed proximate to the first end, the first end of said heater element including an upper surface and a lower surface disposed opposite the upper surface;

an elongated bimetal including a first end and a second end disposed opposite and distal from the first end of said elongated bimetal, said elongated bimetal being structured to move between a first position corresponding to the separable contacts of said electrical switching apparatus being closeable, and a second position corresponding to the first end of said elongated bimetal cooperating with said operating mechanism to open said separable contacts, the second end of said elongated bimetal being coupled to the intermediate portion of said heater element;

wherein, when said elongated bimetal is disposed in said first position, the first end of said elongated bimetal extends beyond the upper surface of the first end of said heater element into the aperture of said heater element;

wherein the intermediate portion of said heater element comprises a plurality of bends defining a plurality of segments; and wherein the aperture of said heater element extends from proximate the first end of said heater element toward a corresponding one of the segments of said intermediate portion; and wherein the aperture of said heater element is an elongated slot; and wherein said elongated slot extends through said corresponding one of the segments of said intermediate portion.

2. A heater assembly for an electrical switching apparatus, said electrical switching apparatus including a housing, separable contacts, and an operating mechanism for opening and closing said separable contacts, said heater assembly comprising:

a heater element structured to be coupled to the housing of said electrical switching apparatus, said heater element including a first end, a second end, an intermediate portion disposed between the first end and the second end, and an aperture disposed proximate to the first end, the first end of said heater element including an upper surface and a lower surface disposed opposite the upper surface;

an elongated bimetal including a first end and a second end disposed opposite and distal from the first end of said elongated bimetal, said elongated bimetal being structured to move between a first position corresponding to the separable contacts of said electrical switching apparatus being closeable, and a second position corresponding to the first end of said elongated bimetal cooperating with said operating mechanism to open said separable contacts, the second end of said elongated bimetal being coupled to the intermediate portion of said heater element;

wherein, when said elongated bimetal is disposed in said first position, the first end of said elongated bimetal extends beyond the upper surface of the first end of said heater element into the aperture of said heater element; and wherein the second end of said heater element comprises a plurality of holes and at least one fastener; and wherein said at least one fastener is structured to extend through a corresponding one of said plurality of holes to fasten said heater element to the housing of said electrical switching apparatus.

3. A heater assembly for an electrical switching apparatus, said electrical switching apparatus including a housing, separable contacts, and an operating mechanism for opening and closing said separable contacts, said heater assembly comprising:

a heater element structured to be coupled to the housing of said electrical switching apparatus, said heater element including a first end, a second end, an intermediate portion disposed between the first end and the second end, and an aperture disposed proximate to the first end, the first end of said heater element including an upper surface and a lower surface disposed opposite the upper surface;

an elongated bimetal including a first end and a second end disposed opposite and distal from the first end of said elongated bimetal, said elongated bimetal being structured to move between a first position corresponding to the separable contacts of said electrical switching apparatus being closeable, and a second position corresponding to the first end of said elongated bimetal cooperating with said operating mechanism to open said separable contacts, the second end of said elongated bimetal being coupled to the intermediate portion of said heater element;

wherein, when said elongated bimetal is disposed in said first position, the first end of said elongated bimetal extends beyond the upper surface of the first end of said heater element into the aperture of said heater element;

wherein the aperture of said heater element substantially divides the first end of said heater element into a first side and a second side; and wherein the first end of said elongated bimetal extends between the first side of said heater element and the second side of said heater element; and wherein the heater element further comprises a crossover segment; wherein the crossover segment is disposed at the first end of said heater element; and wherein said crossover segment extends between the first side of said heater element and the second side of said heater element.

4. An electrical switching apparatus comprising:

a housing;

separable contacts enclosed by said housing;

an operating mechanism structured to open and close said separable contacts;

at least one heater assembly, comprising:

a heater element coupled to the housing, said heater element including a first end, a second end, an intermediate portion disposed between the first end and the second end, and an aperture disposed proximate to the first end, the first end of said heater element including an upper surface and a lower surface disposed opposite the upper surface;

an elongated bimetal including a first end and a second end disposed opposite and distal from the first end of said elongated bimetal, said elongated bimetal being movable between a first position corresponding to the separable contacts of said electrical switching apparatus being closeable, and a second position corresponding to the first end of said elongated bimetal cooperating with said operating mechanism to open said separable contacts;

wherein, when said elongated bimetal is disposed in said first position, the first end of said elongated bimetal extends beyond the upper surface of the first end of said heater element into the aperture of said heater element;

wherein the intermediate portion of said heater element comprises a plurality of segments defined by a plurality of bends; and wherein the aperture of said heater element extends from proximate the first end of said heater element toward a corresponding one of the segments of said intermediate portion; and wherein the aperture of said heater element is an elongated slot; and wherein said elongated slot extends through said corresponding one of the segments of said intermediate portion.

5. An electrical switching apparatus comprising:

a housing;

separable contacts enclosed by said housing;

an operating mechanism structured to open and close said separable contacts;

at least one heater assembly, comprising:

a heater element coupled to the housing, said heater element including a first end, a second end, an intermediate portion disposed between the first end and the second end, and an aperture disposed proximate to the first end, the first end of said heater element including an upper surface and a lower surface disposed opposite the upper surface;

an elongated bimetal including a first end and a second end disposed opposite and distal from the first end of said elongated bimetal, said elongated bimetal being movable between a first position corresponding to the separable contacts of said electrical switching apparatus being closeable, and a second position corresponding, to the first end of said elongated bimetal cooperating with said operating mechanism to open said separable contacts;

wherein, when said elongated bimetal is disposed in said first position, the first end of said elongated bimetal extends beyond the upper surface of the first end of said heater element into the aperture of said heater element; and wherein said at least one heater assembly further comprises at least one fastener; wherein the second end of said heater element of said at least one heater assembly includes a plurality of holes; and wherein a corresponding one of said at least one fastener extends through a corresponding one of said plurality of holes in order to fasten said heater element to said housing.

6. An electrical switching apparatus comprising:

a housing;

separable contacts enclosed by said housing;

an operating mechanism structured to open and close said separable contacts;

at least one heater assembly, comprising:

a heater element coupled to the housing, said heater element including a first end, a second end, an intermediate portion disposed between the first end and the second end, and an aperture disposed proximate to the first end, the first end of said heater element including an upper surface and a lower surface disposed opposite the upper surface;

an elongated bimetal including a first end and a second end disposed opposite and distal from the first end of said elongated bimetal, said elongated bimetal being movable between a first position corresponding to the separable contacts of said electrical switching apparatus being closeable, and a second position corresponding to the first end of said elongated bimetal cooperating with said operating mechanism to open said separable contacts;

wherein, when said elongated bimetal is disposed in said first position, the first end of said elongated bimetal extends beyond the upper surface of the first end of said heater element into the aperture of said heater element; and wherein the aperture of said heater element substantially divides the first end of said heater element into a first side and a second side; wherein the first end of said elongated bimetal extends between the first side of said heater element and the second side of said heater element; wherein the heater element further comprises a crossover segment; wherein said crossover segment is disposed at the first end of said heater element; and wherein said crossover segment extends between the first side of said heater element and the second side of said heater element.

7. The electrical switching apparatus of claim 6 wherein said operating mechanism comprises a movable contact arm; wherein said separable contacts comprise a stationary electrical contact and a movable contact; wherein said movable contact is disposed on said movable contact arm; wherein said heater assembly further comprises a number of shunts; wherein said number of shunts electrically connect said heater element to said movable contact arm; and wherein said number of shunts is substantially disposed on said crossover segment of the first end of said heater element, distal from said elongated bimetal.

8. The electrical switching apparatus of claim 7 wherein said number of shunts is a first shunt and a second shunt; wherein said first shunt is electrically connected to said heater element at the first side of the first end of said heater element; and wherein said second shunt is electrically connected to said heater element at the second side of the first end of said heater element, opposite said first shunt.

* * * * *